US005796084A

United States Patent [19]

Olsson

[11] Patent Number: 5,796,084

[45] Date of Patent: Aug. 18, 1998

[54] DEVICE FOR THE REGISTRATION OF VEHICLE FEES

[75] Inventor: Lars Olsson, Jönköping, Sweden

[73] Assignee: Saab-Scania Combitech Aktiebolag, Jonkoping, Sweden

[21] Appl. No.: 615,231

[22] PCT Filed: Sep. 13, 1994

[86] PCT No.: PCT/SE94/00850

§ 371 Date: Jun. 11, 1996

§ 102(e) Date: Jun. 11, 1996

[87] PCT Pub. No.: WO95/08162

PCT Pub. Date: Mar. 23, 1995

[30] Foreign Application Priority Data

Sep. 16, 1993 [SE] Sweden ..... 9303025

[51] Int. Cl.[6] ..... G07B 15/02

[52] U.S. Cl. ..... 235/384

[58] Field of Search ..... 235/384; 310/329; 364/564; 73/514.01, 514.03, 514.04

[56] References Cited

U.S. PATENT DOCUMENTS 5,351,187 9/1994 Hassett ..... 235/384 X 5,382,780 1/1995 Carmen ..... 235/384

5,428,353 6/1995 Bird ..... 235/384 X 5,451,758 9/1995 Jesadanont ..... 235/384

5,498,859 3/1996 Farmont ..... 235/384

*Primary Examiner*—Donald T. Hajec

*Assistant Examiner*—Karl Frech

*Attorney, Agent, or Firm*—Lowe, Price, LeBlanc & Becker

[57] ABSTRACT

A device located in a vehicle for the registration of fees. It includes an activation unit for remote communications, a time counter, a sensor for sensing the traveling status of the vehicle from travel to immobility, a maneuvering unit for starting and stopping the registration of the parking time, a registration unit for the vehicle fees and preferably a signal unit for indication of whether the vehicle fees are registered. The time counter is arranged to register cost in dependence on time partly during periods when the sensor indicates movement in the vehicle and partly when the maneuvering unit indicates parking position of the vehicle, where no fee registration occurs when the sensor indicates that the vehicle is running and the maneuvering unit is not set on parking position. The sensor is an accelerometer.

8 Claims, 1 Drawing Sheet

DEVICE FOR THE REGISTRATION OF VEHICLE FEES

The device is intended for the registration of vehicle fees such as road and bridge tolls and for the registration of staying, including parking, within the toll area such as city cores so that the fees can be debited or preferably deducted from a prepaid card.

TECHNICAL FIELD

It happens that in road toll facilities fees are collected for passing highways, bridges, tunnels and other roads with high production costs. Hereby, an economic contribution is gotten to the production and maintenance costs. At first, the toll was taken up manually in toll booth counter that the vehicle had to pass. Later, pay cards were introduced as well and stop gates which temporarily opened at the presentation of the card. The most recent development comprehends, that in the toll facility entrance there is a facility for remote reading of identification units on passing vehicles, so that no stopping will need to occur. Usually, for communication a microwave transceiver is used in the fixed unit and transponders in the vehicles. Thereby the technique described in U.S. Pat. No. 4,739,328 (Koelle et al) can be used. For registration on the fee, the identity of the vehicle is fetched from the vehicle unit, which makes it possible to debit the fee. A still more rational system is obtained if the fixed unit activates the registration of the fee in the vehicle unit, so that the fee can be deducted from a prepaid card, a so-called Smart Card, with which the vehicle unit can be provided.

It also happens, that it is desired to provide areas of congested traffic, such as city cores, with entry tolls. In such cases, the possibility of gainings is not the main goal, but the most important thing is usually that, hereby, means is provided to limit the traffic in such areas in that unnecessary driving is decreased and a greater motivation is created for the transfer from passenger transports with car to public transportation means. Due to the development of the technique with remote passage-registration, the interest has increased for arranging this kind of zone tolls.

Within zones where entry checks through toll facilities is of interest, generally occur parking problems in addition to the problem with congested traffic. For a long time it has been known to control parking with fees, which mostly are paid by means of parking meters. In addition to the guidance of long-term parking on particular away from the most frequented streets and places, a certain economic contribution to construction and maintenance of the parking places is achieved.

However, the system with parking meters has many disadvantages. They require for example a number of personnel for surveillance; in order to maintain the paying morale and for the control to be effective, every vehicle must be checked at certain intervals by patrolling guards. Installation and maintenance and service and emptying of parking meters require considerable costs and the meters often give an unbeautiful impression in the city picture and make street cleaning more difficult. For the user, they are uncomfortable in that he or she is often uncertain of for how long time the necessary prepayment shall be paid. A too late return to the vehicle means risking parking fine, and to pay for a longer time than one has planned to use, mostly means unnecessary costs. An alternative system to parking meters are areas or multi-storey car park with exit cash desks, where one pays for the time between entry and exit, which in certain respects is a smoother system. It can however only be applied to a limited extent un urban areas in which it is mostly necessary to arrange with parking possibilities along street and in small, spread parking-grounds.

In order to find a parking system without said disadvantages, so-called P-boxes have been developed. Such contain a time counter that can be started and stopped manually. A registration unit registers the time that the counter works and hereby debiting can occur, in the occurring P-boxes on a Smart Card. Usually, in addition to starting and stopping means there are also means for selecting the determined parking cost per hour, which can vary from one place to another.

The P-box is located visible in the vehicle and is started when the vehicle is parked in a place where payment shall be made. An indication on the P-box shows outwards that the box is in function and that there is sufficient means on the card so that debiting can occur.

Said vehicle unit, which is arranged for paying road tolls, and the P-box have to a certain extent the same arrangement, which is means for registration after activation of a cost, which usually is deducted from a Smart Card. Thereby, the idea has come up that a device for payment of both road tolls and parking fees could be provided. If such a combined unit is manufactured it is close at hand to use the possibility of remote activation also in parking situations, and thereby in connection with entry into a toll zone. In order to provide such a combined device, however, it is required that certain problems according to the following are solved.

Obtaining a fair debiting in a zone such as a city core for the various conceivable forms of a stop in the zone is not possible only through registration of entries and thereafter visiting time in the zone either through the registration of the exiting as well, or by means of a time counter. This limitation can be avoided if also registration is introduced of the visiting time, divided in the part time when the vehicle is in motion and the part time when the vehicle is immobile. Immobility means either some form of parking or forced immobility due to red lights, traffic jams, road work or other forced blockings. In the case of fee parking, the fee can be collected in the afore-mentioned ways, and also in the way that is suggested in connection with the present invention. Forced stops, however, lie out of the driver's control and should not be debited. In the discussion it has been pointed out that forced stops or slow traffic flow is a symptom of too great a traffic load and that any one staying in the zone in question when such an overload occurs should be "punished" for it with higher fees. This can however be achieved in a less random and for the vehicle owner more controllable way through raised hour rate during periods with congested traffic.

In the patent specification WO 90/15401 (Hunter et al) a device is suggested for charging vehicle fees at stops in zones with congested traffic. Here, it is attempted to solve said problem of achieving a fair debiting in dependence on how the stop in the zone occurs. As a means hereto, it is suggested that the device in question is connected to the driving means of the vehicle, such as its distance meter.

Hereby, periods of stops and of movements can be registered and, on movement, the covered distance and the speed. It is conceived that a low speed shall be used as an indication that the vehicle owner unnecessarily has chosen times and road distances that means forced low speed, which however should mean a not negligible randomness in the debiting.

The use of the vehicle speed and the road distance as means of indication of the size of the fee can therefore be questioned, whereas registration of the periods of movements and of immobility is a more essential means on which a just debiting can be based. To obtain such an indication on the in the specification suggested way with connection to the driving means of the vehicle, means in practice several essential disadvantages. In the established way to produce vehicle units for the debiting of road tolls, such connection to the vehicle machinery is avoided and can hereby make the vehicle unit a separate unit for the simplest possible attachment to the vehicle. To connect a vehicle unit for example to a speedo- and distance meter means tampering with the vehicle, which at least in some vehicles can be considerable and which must be different from one vehicle to another.

DESCRIPTION OF THE INVENTION

With the aid of the device according to the invention the following can be obtained:

1. Registration of a fixed fee on passage through a toll facility, if such is present.
2. Starting of a time counter on passing a toll facility into a zone.
3. Registration of time-based cost during driving in the zone according to a certain fee rate for this.
4. Possibility of stopping in the zone without time debiting when standing still.
5. Possibility to activate, manually or automatically, the time counter for the registration of the time for a stop in parking place subject to a fee, with possibility of setting the current zone rate.
6. Stopping the time counter so that registration ceases on exiting the zone.
7. Means for rational monitoring so that a fee is registered at a stop in a place subject to a fee.

These possibilities can according to the invention be obtained with an apparatus, which does not require any active connection to the vehicle, but can be designed as a separate device, possibility in a few units.

PREFERRED EMBODIMENT

Figure 1:
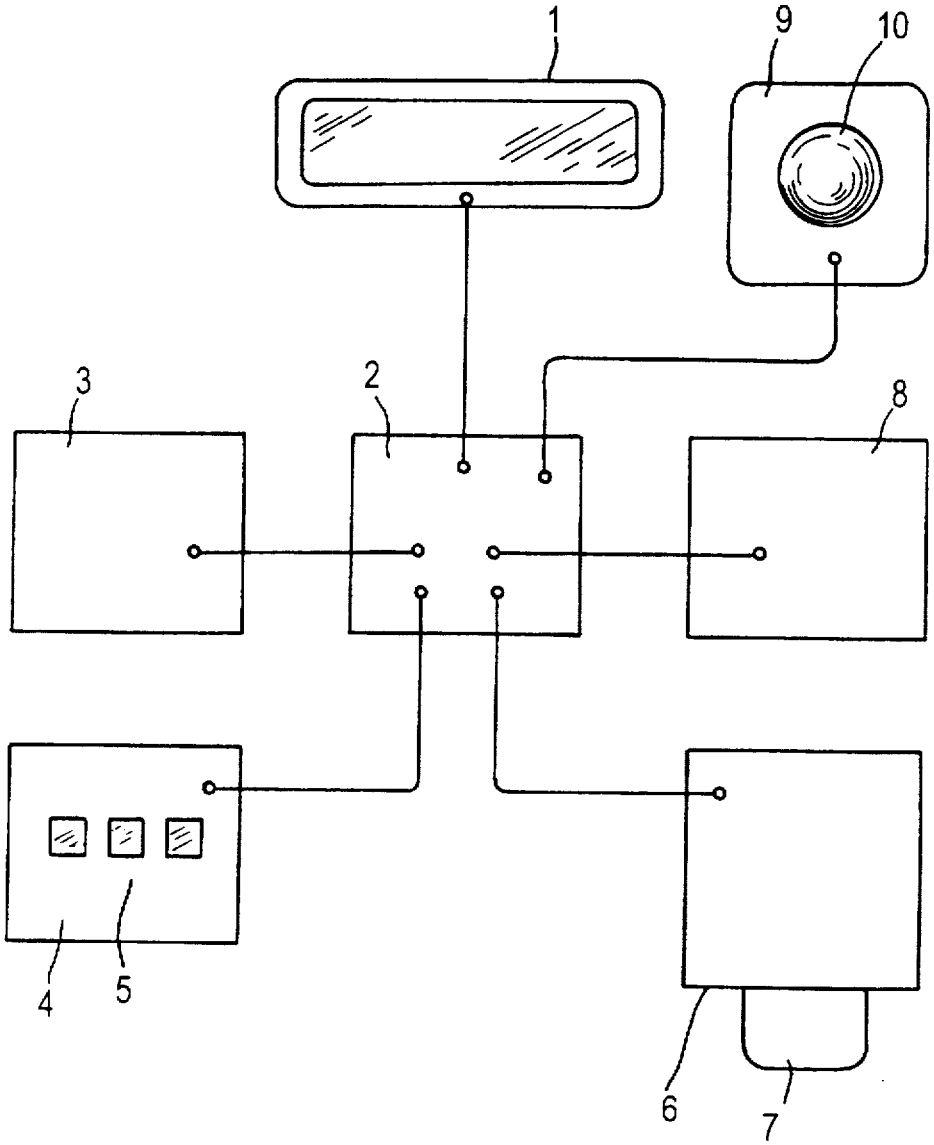
FIG. 1 shows a block diagram of an embodiment of the invention.

The device is shown in the FIGURE as a number of blocks of functional units. These units can naturally, despite their separation in the FIGURE, be joined to an apparatus in a mutual housing, when should be preferable for a simple attachment in the vehicle in which the device is to be used.

The device consists of a functional unit 1, which is a unit for activation and communication. In the FIGURE it is suggested that the activation unit 1 is a transponder, which is intended to be activated by a microwave transmitter on passage through a road or zone toll facility. With the aid of a microwave transceiver in the toll facility the transponder can both activate the device on a certain command from the transmitter and modulate the received signal in such a way that a message is picked up by the transceiver in the road toll facility.

The activation unit 1 is connected to a microcomputer 2, which stands in connection with the other units belonging to the device. Of these, a counter is designated by 3, which counter after start and up to stop indicates the time that passed to the microcomputer 2. A manoeuvering device 4 is arranged for start and stop manoeuvers and for the determination of the rate of fee on parking, which is here marked with a number of manoevering buttons 5.

Furthermore, there is a debiting unit 6, which is arranged for a Smart Card 7 to be inserted, i.e. a prepaid card. After insertion in the registration unit 6, fees are deducted from the determined, prepaid amount in accordance with the cost indicated from the activation unit 1 and the time counter 3, which shall be described hereafter.

Furthermore, there is a sensor 8 for sensing movement in the vehicle in which the device is located. The sensor 8 has, the most advantageously, the form of a accelerometer, which registers movement in the vehicle through the forces of acceleration which appear thereby. Such forces appear both through the accelerations and the retardations of the vehicle and through the vibrations and bumps that always appear because of certain irregularities in the roadway surface. The choice of a accelerometer for registering movement or immobility in the vehicle is due to the fact that such an accelerometer can work without any connection to any means in the vehicle such as a wheel shaft, a motor shaft or the ignition system of the engine for example. Therefore the accelerometer can be entirely built into the apparatus housing and the device can be designed as one single unit, which only needs to be located in a suitable place in the vehicle without any installation or connection.

Furthermore, the device comprises a signal unit 9, preferably for emitting a light signal from a source of light 10 in situations that are evident from the following.

The device works in the following way:

The device is understood to be located in a vehicle, which shall pass into a toll facility area, for example a city core, in which it can be supposed that the vehicle partly will travel around and partly will use the parking places that are subject to fees. The transponder of the activation unit 1 is so located that it is accessible for microwaves. On passing a toll zone for the area in question, the transponder receives a signal from a transceiver located in the toll facility. Thereby the device for fee registration is activated.

In the preferred embodiment according to FIG. 1, debiting of the registered fee was understood to occur through deduction from the card 7. In order that this shall occur, sufficient means must be left on the card. That such is the case is checked from the toll zone transceiver in that the transponder on activation retransmits a modulated signal, which in a code system designates the payment status of the card.

The device may as an alternative to fee deduction from a prepaid card be arranged for debiting an account connected to the apparatus. Instead of transmitting to the transceiver information on the payment capability according to the cards, an identification regarding the account in question is transmitted, so that debiting can take place from the account. Other alternative debiting methods can also be conceived, for example written registration of the fees for post-payment by showing the written record.

As mentioned, an activation of the apparatus upon passage of the toll facility occurs. This activation leads to the triggering of the time counter 3 and as the case may be also to the registration of an entrance fee. The purpose with the device is that travel with the vehicle within the zone shall be charged with a time-dependent fee. In addition, as said, a special entrance fee can be determined, but alternatively the fee can be entirely dependent on the time of staying in the zone.

The running of the time counter 3 is dependent on whether the vehicle is in motion or not. The registration via the microcomputer 3 to the registration unit 6 is dependent on whether the vehicle is in motion or not. This is detected by the accelerometer 8. Hereby the time counter works with registering the fees according to a rate determined for the traffic in the zone. As soon as the vehicle stops, this is registered by the accelerometer, and the fee registration, through the activation of the counter, ceases.

At stops, two cases may occur: either the vehicle is parked in a parking place subject to a fee, or it has stopped in a place or in a position in which no fee is stipulated. Such a place could be a private parking lot or garage or a parking lot free-of-charge, for example a loading zone, or else the vehicle can have stopped on the roadway because of red lights or traffic jam.

In the first case, a time-related fee shall be paid for the parking and the device shall therefore serve the purpose of being a P-box, whereas in the second case no fee shall be registered. This is also the case for immobile vehicles in that the accelerometer prevents registration from the time counter. If, however, the vehicle stands in a parking place subject to a fee, the counter must be brought to register a time-related fee, which is dependent on the rate of fee for the place in question. In other words: on parking in a location subject to a fee after stop of the time counter by means of the accelerometer, the registration from the time counter must restart for debiting according to relevant rate. For this purpose, the manouevering unit 4 is arranged. Manual restart can thereby occur by pressing the button for current rate or by means of any other manouevering means. If the vehicle is stopped in any other position than in a place subject to a fee, there shall be no restarting of the time counter.

It should be necessary that a check be effected of whether the time registration has actually been activated after parking in a place subject to a fee, and in addition thereto, according to the current rate, and furthermore that on using Smart Card, that there is means available for deduction from the card 7. In order to provide such checking possibilities, the signal unit 9 is arranged. It shall indicate that the fee registration is going and suitably also indicate according to what rate of fee the registration occurs. In the FIGURE, it is understood that a light indication 10 is used for this purpose, which can be designed both to indicate that registration occurs and the determined rate of fee through for example a certain blinking pattern or through a display on the signal unit.

When the vehicle drives out of the toll zone it passes again a toll facility in which a transceiver is located. From it the transponder receives a signal that resets the device to a resting position so that fee registration no longer occurs.

Naturally, several toll zones with different rates of fee can be adjacent to eachother. On passing such a zone border the registration is not made passive but switches over to the new rate of fee.

When traveling on toll roads the device shall function as an ordinary fee registration device for this purpose. The road toll facility, which also here is understood to function with microwaves, transmits an activation signal, which is coded in a way different from the signal that is used at zone toll facilities. This leads to registration in the device of the determined fee for the distance in question and retransmission of a signal from the activation unit 1 that the fee in question is registered.

The device according to the invention has thus four functions:

to make fee registration possible on entering a toll zone;

to make time-related debiting possible for traffic within the zone with such fee registration being discounted at stops in the zone;

to make activation possible for the time-related registration of parking fees with the possibility of excluding such registration at stops in not fee-related location or place; and to make debiting of a fee possible during the passage of a road toll gate to a distance subject to a fee.

Within the scope of the inventive idea the device can be designed in a way that differs from the described, preferred embodiment. The activation unit can for instance be arranged for another type of remote manouevering than through microwaves, for example with the aid of IR light or in any other way. To make use of a movement detector in the form of an accelerometer is as mentioned advantageous because such can function without connection to any means on the vehicle.

An accelerometer, if it is connected to a time counter and a processor, can also be designed for measuring the speed, not only the conditions, movement and immobility. A time integral of the forces of acceleration is thereby a basis for calculation of the speed and its changing. By making further calculation of speed times time, a value of covered length can be obtained. All of this is done only under the activation of inertial forces without mechanical/electrical vehicle connection.

For environmental reasons the device can be arranged to register a time-dependent fee for idling, i.e. when the vehicle engine is running and the vehicle stands still. This can for example be achieved with a sensor which detects differences in the movement pattern between immobility with the engine switched off or switched on, and when the vehicle is moving, respectively.

As to the function of restarting the time counter at parking in a place subject to a fee, this has been described as a manual manouever. It is however not excluded, that an automatic manouever can be achieved, in certain parking places possibility by means of microwave through the use of the transponder of the device. A more selective activation of the parking function should be possible to obtain though induction loops in the parking ground with the device provided with sensing devices for magnetic fields.

If however, manual activation of the parking function is used, the then necessary supervision that the parking rules are followed is facilitated through a well-designed signal device such as for example some remote communication with the supervisor. It can thereby be possible to use the transponder for such communication.

It should also be mentioned that the device for signalling that the correct parking function is set on, is suitably combined with some warning, for example through a sound signal to the driver, when the vehicle has been standing still for a short period of time, whereby the risk that the parking function is not activated sue to negligence can be limited.

I claim:

1. A device for the registration of vehicle fees located in a vehicle and comprising an activation unit (1) arranged for remote communication, a timer counter (3), a sensor (8) arranged for sensing the vehicle travelling status from travel to immobility, and a registration unit (6) for the vehicle fees, arranged for debiting successively registered fees against a prepaid card (7) and also a signal unit (9) arranged to indicated the momentary status regarding the registration of the vehicle fees, characterized in that the sensor (8) for sensing the travelling status of the vehicle is constituted by an accelerometer, which is arranged under the effect of the inertial forces on movement of the vehicle to detect its travelling status and thereby arranged to control the registration unit (6).

2. A device according the claim 1, characterized in that the time counter (3) is arranged so that after activation of the device by means of the activation unit (1) it registers cost depending on time partly during periods when the sensor (8) indicates movement activity in the vehicle and partly when by means of the manouevering unit (4) the parking position of the vehicle is indicated, whereas no fee registration occurs when the sensor indicates that the vehicle is not in operation and the manouevering unit is not set on parking position.

3. A device according to claim 1, characterized in that it comprises a manouevering unit (4) for starting and stopping the registration of parking time, adjustable for different parking rates of fee.

4. A device according the claim 1, characterized in that the activation unit (1) is arranged to be controlled through remote control from a radiation transmitter, such belonging to a toll road or zone.

5. A device according to claim 4, characterized in that the activation unit (1) is arranged as a transponder for receiving radio signals for controlling the device and to retransmit signals carrying information on the status of the device.

6. A device according to claim 1, characterized in that it is arranged both for registration by means of the time counter (3) of the calculated fee during operation and parking position, respectively, and for registration of predetermined specific fees on the passage of an activation place.

7. A device according to claim 1, characterized in that the accelerometer (8) is arranged selectively to sense partly the travelling status in the form of idling while standing still by means of sensing the forces of acceleration through vibrations and partly in the form of periods of vehicle motion by means of sensing the forces of acceleration appearing through the vehicle acceleration and retardation.

8. A device according to claim 1, characterized in that the accelerometer (8) is connected to a processor, arranged on the basis of the forces of acceleration measured by the accelerometer and on the basis of their time relations to calculate the speed and/or covered distance of the vehicle.

* * * * *